US006702633B1

(12) United States Patent
Johnson

(10) Patent No.: US 6,702,633 B1
(45) Date of Patent: Mar. 9, 2004

(54) UNIVERSAL FLOAT TUBE AND PONTOON BOAT PROPULSION FIN

(75) Inventor: Carroll Johnson, Grand Junction, CO (US)

(73) Assignee: Dux Fin Co., Grand Junction, CO (US)

( * ) Notice: Subject to any disclaimer, the term of this patent is extended or adjusted under 35 U.S.C. 154(b) by 0 days.

(21) Appl. No.: 10/274,318

(22) Filed: Oct. 18, 2002

Related U.S. Application Data

(60) Provisional application No. 60/348,159, filed on Oct. 19, 2001.

(51) Int. Cl.[7] ..... A63B 31/08
(52) U.S. Cl. ..... 441/64
(58) Field of Search ..... 441/64

(56) References Cited

U.S. PATENT DOCUMENTS

| | | | | |
|---|---|---|---|---|
| 1,130,209 A | | 3/1915 | Sommerfeld | |
| 1,794,883 A | | 3/1931 | Corder et al. | |
| 2,276,082 A | | 3/1942 | Meyers | 9/20 |
| 2,395,844 A | | 3/1946 | Bufkin | 9/21 |
| 3,183,529 A | | 5/1965 | Beuchat | 9/309 |
| 3,268,927 A | | 8/1966 | Markowitz | 9/304 |
| 3,432,868 A | | 3/1969 | Lowery | 9/343 |
| 4,664,639 A | | 5/1987 | Schneider | 441/61 |
| 4,857,024 A | | 8/1989 | Evans | 441/64 |
| 4,940,437 A | | 7/1990 | Platt | 441/61 |
| 5,108,327 A | | 4/1992 | Klein | 441/62 |
| 5,292,272 A | | 3/1994 | Grim | 441/62 |
| 5,527,196 A | | 6/1996 | Harkins | 441/61 |
| 5,531,621 A | | 7/1996 | Johnson | 441/61 |
| 5,593,333 A | | 1/1997 | Johnson | 441/62 |
| 5,597,336 A | | 1/1997 | Evans | 441/61 |
| 5,645,460 A | | 7/1997 | Johnson | 441/61 |
| 5,692,932 A | | 12/1997 | Lance et al. | 441/60 |
| 6,077,139 A | * | 6/2000 | Celik | 441/64 |
| 6,126,502 A | * | 10/2000 | Hull | 441/63 |
| 6,129,601 A | * | 10/2000 | Aucoin | 441/64 |
| 6,227,923 B1 | | 5/2001 | Johnson | 441/61 |
| 6,247,982 B1 | * | 6/2001 | Walker | 441/64 |
| 2002/0028618 A1 | * | 3/2002 | Hashizume et al. | 441/64 |

OTHER PUBLICATIONS

"Paddle Pushers" Brochure—Mfg. by Fishmaster Mfg. Co., Oaklahoma City, OK.
"Float Striders" information sheet—Underlying Patent is U.S. # 6,077,139.

* cited by examiner

*Primary Examiner*—Stephen Avila
(74) *Attorney, Agent, or Firm*—John L. Isaac; Isaac & Asso.

(57) ABSTRACT

A universal foot fin is disclosed for use with float tubes and pontoon boats which can be selectively adapted to propel either forward or backward in the water, while simultaneously allowing the user to walk forward in either adaptation without removing the fin assembly. The fin assembly is described as being either (in simplest form) a separate FIN member to be attached to mounting fixtures which can be permanently affixed to or molded integral on wading boots, or as a complete assembly including a base member to be secured to wading boots by an releasable binding mechanism In use the fin member pivotally retracts in an upward position for walking.

1 Claim, 10 Drawing Sheets

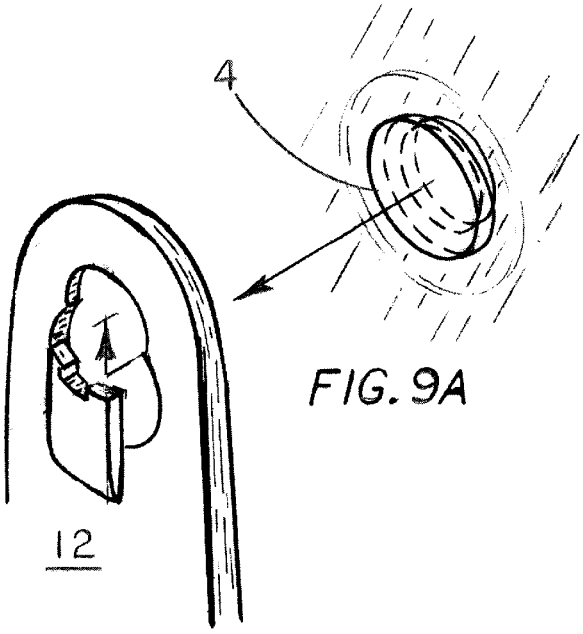
FIG. 9A
FIG. 9
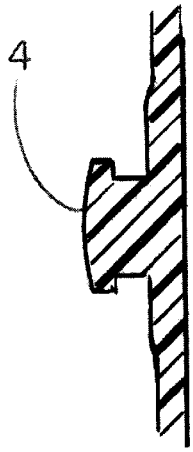
FIG. 9B
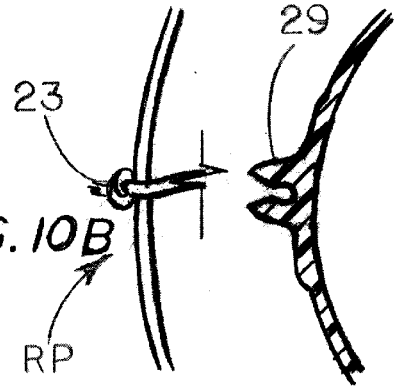
FIG. 10B
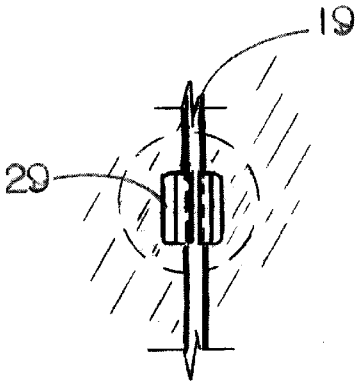
FIG. 10
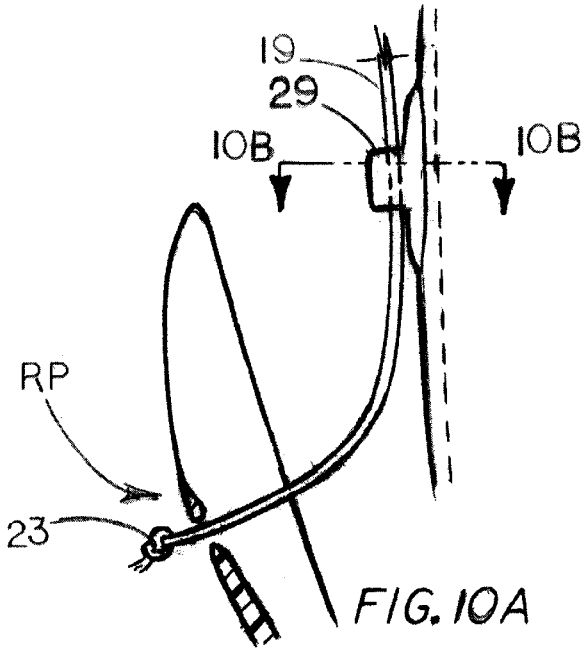
FIG. 10A

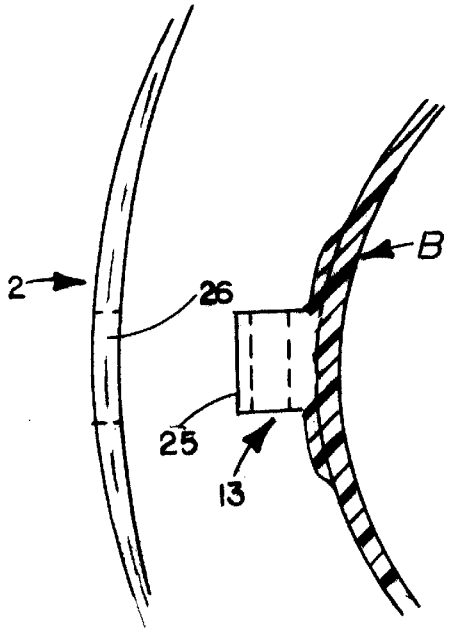
FIG. 11A
FIG. 11B
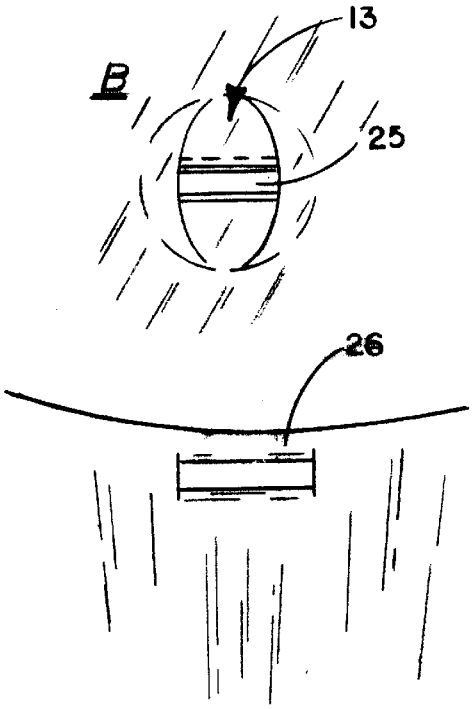
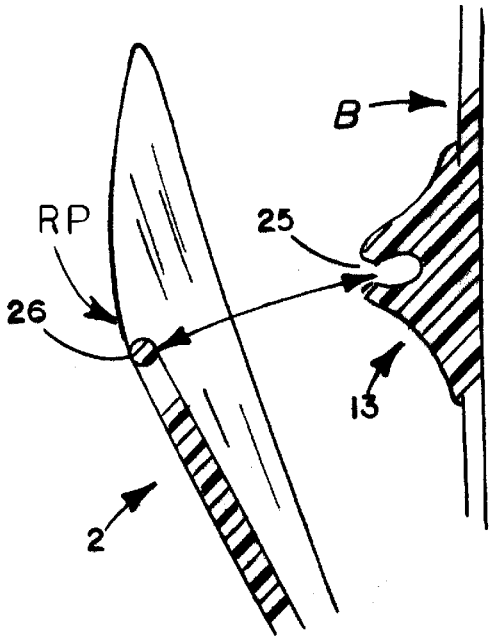
FIG. 11

UNIVERSAL FLOAT TUBE AND PONTOON BOAT PROPULSION FIN

CROSS-REFERENCE TO RELATED APPLICATION

This application is entitled to the benefit of Provisional Patent Application No. 60/348,159, filed Oct. 19, 2001.

BACKGROUND OF THE INVENTION

1. Field of Invention

This invention relates generally to a propulsion mechanism for use with float tubes (aka. "belly boats"), pontoon boats, and other float devices commonly used in fishing, duck hunting, and other aquatic pursuits and, more particularly, to a foot fin assembly for propelling the user of such devices. Specifically, the present invention relates to an improved universal foot fin assembly which is easily adaptable for use in propelling the user of a float tube or other float device in either a forwardly facing direction or a backwardly facing direction in water while simultaneously permitting the user of such foot fins to walk in a forwardly facing direction in shallow water and on land without removing the fin assembly.

2. Description of the Prior Art

In general, users of float tubes and similar aquatic apparatus use some type of propulsion aid on their feet to assist in moving about the water's surface. Most float tube fins presently used are similar in design to the foot fins used by swimmers and divers. Illustrations of such fins include those shown in U.S. Pat. Nos. 3,183,529, 4,857,024, 4,929,206, 4,940,437 and 5,597,336. Such devices operate by movement of the user's legs and feet in a flutter kick which propels an outstretched swimmer or diver in a forward direction. Conversely, they propel a person seated in or on a float tube or similar device rearwardly or backwardly relative to the direction he or she is facing. This backward movement is preferred by pontoon boat users on moving streams who need to face downstream and propel backwards to steer a course and avoid obstructions. However, still water float tube users generally desire to move forward when moving about on the water or casting to rising fish.

The forward extending fin blades of the previously described fins restrict foot movement, creating a risk of tripping and falling while walking with the fins on. Walking in marginal water to enter or exit a body of water is particularly hazardous, for in addition to the clumsiness of the protruding fins and the limitations of movement and visibility caused by the float tube the walker has to overcome the water's resistance on the fins with each step. As a consequence, most users of forward extending fins walk backward to enter and exit the water. Walking and wading backward, especially without use of the arms and hands as a balancing aid (that use precluded by hand carrying the annular float tube in position about the lower torso) creates a significant danger of falling, injury and drowning. Strenuous backward kicking with such prior art fins tends to cause leg cramps and fatigue.

The process of donning and removing a round float tube while wearing such forwardly extending fins is also difficult and hazardous. For example, the bulk and shape of a float tube limits movement, necessitating that the fins are attached to the user's feet prior to donning the float tube. In such an instance, with the float tube lying flat on the ground and the fins attached to the user's feet, the user balances on one foot while stepping over the circumference of the tube with the other foot to insert that foot with fin into the leg opening of the float tube seat. Thus straddling the tube, the user then shifts his or her balance to the foot now inside the tube so as to lift the opposite foot with fin over the tube and insert it also into the leg opening of the seat. The forward extension of such prior art fins, their general configuration and size, and the constriction of the seat of an annular float tube makes it extremely awkward to insert both feet with fins in place into the leg opening of a float tube. Balancing is especially difficult while bending over to maneuver the unwieldy tube into position to facilitate inserting the forward extending fin of the second foot into the leg opening.

As the result of such difficulties, several fins have been developed to provide a means of forward propulsion by float tube users. Moreover, designs have been provided wherein a single paddle is secured to an existing shoe of a float tube user. Such designs include U.S. Pat. Nos. 2,395,844, 4,664,639 and 5,527,196. Other designs such as U.S. Pat. Nos. 2,276,082 and 3,432,868 have provided elongated or funnel shaped fins attached to the outside sides of the legs as an integral part of wading boots or waterproof garments for float fishing. A device known as the Paddle Pusher which is manufactured by Fishmaster Manufacturing Co. of Oklahoma City, Okla., provides side paddles to be worn on existing tennis shoes or other foot gear. The design of the previously described fins compel a float tube user to assume an unnatural forced vertical posture to propel the float tube on the water. Moreover, these designs are generally inefficient lacking the advantage of an extended longer arc of leg movement in the water which can be gained by positioning the fin in its operating position underneath the foot of a user. They also lack the advantage of a fin biased to an operating position from which the fin will generate usable thrust more rapidly than a fin which must be initially extended to its operating position by movement through the water. The design and construction of a float tube seat typically places a user thereof in the posture of a person seated in a chair with his or her legs and feet extended generally outwardly and forwardly. In such a position kicking is restricted to lower leg movement with the legs pivoting at the knees, not the hips as is assumed in many prior art devices.

Use of the fin disclosed in U.S. Pat. No. 4,664,639 in which the fin is integrally secured as part of the sole of the shoe or as part of a sleeve that fits over the shoe requires the user to lean forward against the designed posture of the float tube in order to position his or her body and legs in a generally upright vertical plane to provide a sufficient length of kick to make use of the device. This is due to the fact that the integral fin flap is by its nature biased toward its retracted position against the shoe sole necessitating unusual motion and force from the leg and foot of the float tube user to extend the fin away from the sole of the shoe and into position to create forward user motion. The devices of U.S. Pat. Nos. 2,276,082 and 3,432,868 and the Paddle Pusher also compel the user of a float tube to assume a forced, generally upright vertical position to move through the water. Much of the user's leg motion with these devices is wasted, and such awkward movement within the float tube is inherently uncomfortable.

U.S. Pat. No. 6,077,139 provides a fin surface of coated fabric into which tubular ribs are sewn to stabilize the fabric in a generally planar fin surface. The device attaches loosely downwardly and behind the heel of the user's foot, being secured to the user's boot by woven straps and buckles. In walking to enter and exit the water the fin surface drags on the ground behind the user's foot, thereby creating a danger of tripping and falling if the user of the device were to be in a rearward off balance position. In such an off balance position, the fin surface and its integral ribs would catch on the ground restricting or preventing a backward movement of the user's foot to regain his or her balance thus causing the user to fall over backward. In use in water the fin hangs downwardly from its attaching straps, being biased toward an operating position only by the forces of gravity and an adjustment in fin width by the manner in which the heel straps are adjusted to the user's foot. Because it is not positively biased to its open operating position the fin frequently does not fill with water in a kicking motion and thus is generally inefficient. Many users of float tube fins do not wear boots, preferring to eliminate the weight of the boot by using only "stocking foot" waders. If used over stocking foot waders the device tends to slip off the foot since there is no protruding boot heel to retain the fin and its attachment straps. The maker of the device suggests that its position can be reversed on the user's foot to propel backward for trolling or going backwards. Movement on land and wading to enter or exit a body of water with the fin in this reversed position would of necessity be restricted to walking backward as the forward facing fin member dangling loosely from the users ankle would catch on the ground if the user were to attempt to walk forward. In either direction the user must walk upon a portion of the tubular center rib, which is painful if wearing only stocking foot waders, and unstable if wearing boot foot waders.

The devices of my U.S. Pat. Nos. 5,531,621 and 5,645,460 overcome many of the objections to the prior art devices described above, although the hinging arrangement and means of extending the fins of these inventions can sometimes be a little awkward in moving them from the closed to operative positions. Both devices are rather complicated and expensive to manufacture. The device of my U.S. Pat. No. 5,593,333 improves the ease by which a user can move the device from its reset position for minimum water resistance to its operative position for paddling or to a fixed position for walking in shallow water. However, the hinging means and bias means for the device are heavy and expensive to manufacture. Maintaining free movement of the hinging requires special lubricant impregnated bushings and Salt water use presents a corrosion problem due to electrolytic activity of dissimilar metals used in the spring and hinge. The device of my U.S. Pat. No. 6,227,923overcomes most of the use and performance objections, although the stresses of walking upon the fin surface over rocks and other debris necessitates constructing the fin member of high quality durable material such as polyurethene. As with most premium materials, urethenes are quite expensive, requiring the fin to be priced at a rate considerably higher than the more popularly priced swim fins. Further, a need still exists for a pontoon boat fin for river fishermen which allows unrestricted forward walking and wading while also propelling the user in a backward direction on the water.

OBJECTS AND ADVANTAGES

Accordingly, it is one object of the present invention to provide an improved universal float tube fin that is simpler, lighter, more efficient and less costly to manufacture which allows a user to walk forward on land and in shallow water and which can be selectively assembled to enable a float tube user to propel either forward or backward on water.

It is another object to provide a more durable improved float tube fin having fewer separate moving parts requiring less maintenance and reducing the potential for lost or broken parts.

An additional object is to provide a fin assembly of a design which does not require special release mechanisms to prevent injury to the user which could occur by the fin becoming entangled in mud or debris.

To achieve the foregoing and other objects and advantages which will become apparent from a consideration of the ensuing description and drawings in accordance with the purpose of the present invention as embodied and broadly described herein, an improved fin assembly in three separate distinct embxxlinets is disclosed for attachment to the foot, foot covering, or boot of a float tube or pontoon boat user (or the user of a similar device) . . .

In the first of two preferred embodiments fin members and unique wading boots are provided in which the fin members can be removably selectively attached to mounting and latch fixtures which are molded integral as part of the wading boots, the mounting of the fin members to the fixtures providing an articulated coupling which allows the fin members to be selectively retained in a first retracted position wherein the fin member is positioned above the sole of the user's boot to enable the user to walk upon a surface without removing the fin members or in a second extended operating position below the sole of the user's boot for propelling the user in the water. The fin members of the first preferred embodiment can also be selectively removed from the wading boots for conventional use of the waders.

In the second preferred embodiment similar fin members are provided as part of a kit which also includes separate mounting and latch fixtures to be permanently affixed to conventional wading boots by cementing, vulcanizing, or other known permanent attachment means in such manner that the fin members of the second embodiment (which can be selectively attached to the mounted fixtures permanently affixed to the user's boot) can also be selectively removed for conventional use of the waders without the fin member being attached to them.

In a third preferred embodiment similar fin members are removably selectively attached to mounting and latch fixtures which are molded as integral parts of a base member which can be removably attached to conventional wading boots or over stocking foot waders or other foot gear of the user. In this embodiment a separate retracted position latch member may be provided to be permanently or removably attached to the user's waders, legs, or covering thereof . . . the boot or foot covering having a sole, toe, ankle, and heel portions. The assembly includes a fin member having a front end portion, a rear end portion, an upper surface, a lower surface, and right and left sides. The fin member is connected to a removable, permanently attachable, or permanently installed mounting means for releasably attaching the fin member to the boot or foot covering of a float tube user. The mounting means further provides an articulated coupling of the fin member which allows the fin member while the fin assembly is attached to the user's foot to be selectively retained in a first retracted position wherein the fin member is positioned above the sole of the user's boot to enable the user to walk upon a surface without removing the fin member or fin assembly or to be selectively pivoted to and retained in a second base operating position wherein the fin member is positioned below the user's boot sole for use in propelling the user in the water. Flexure characteristics of the composition of the fin member material, the limiting configuration in which it is constructed, and an integral hinge means allow the fin member to establish a first fully extended operating position in a power kick in which the flexure of the fin member is limited from exceeding the optimum position for maximum resistance to the flow of water against its upper surface when the fin member is moved through the water with the fin member upper surface leading into the direction of movement against the water thereby propelling the user in the opposite direction. In a second return operating position in which the lower surface of the fin member is moved leading into the water the fin member feathers in response to pressure of water flowing against the lower surface, freely pivoting on the base member mounting studs until contact of latch structures formed in the extending sides of the fin member and on the sides of the base member or boot restrict further travel. Having been retained by the latch means the fin member then continues to feather, flexing at a hinge point established by apertures in the fin surface adjacent to cleavages in stiffening ribs which are formed integral with the underneath surface of the fin member to the limiting characteristics of the material from which the fin member is constructed offset by the pressure of water against the fin member lower surface. When so feathered in the return operating position the plane of the rear portion of the fin member is generally more closely parallel to the plane of the sole of the users boot than when the fin member is freely positioned in its base operating position. In the feathered return operating position the fin offers minimal drag or resistance to the flow of water against its lower surface.

Still further objects and advantages will become apparent from a consideration of the ensuing description and drawings.

BRIEF DESCRIPTION OF THE DRAWINGS

The accompanying drawings which are incorporated in and form a part of the specification illustrate preferred embodiments of the present invention and, together with a description, serve to explain the principles of the invention. In the side views of the boot and the mounting and hinging of the fin member, the reader should understand that there are corresponding similar inside and outside sides and similar left and right fins even though only one side may be illustrated.

In the drawings:

FIG. 1A shows the fin mounted on the rear studs oriented for forward propulsion in a rearward power kick. FIG. 1B shows the fin mounted on the front studs oriented for rearward propulsion in a forward power kick.

FIGS. 9, 9A & 9B show details of the fin mounting studs, and the mating "keyhole" aperture and locking tab in the fin member side extensions.

FIGS. 10, 10A & 10B show details of the preferred retracted position cord latching structure, into which the fin retaining cord is wedged to hold the fin member in its fully retracted position for walking FIGS. 11, 11A & 11B show details of an alternate fin retracted position latch structure, used to hold the fin member in its fully retracted position for walking.

DETAILED DESCRIPTION OF THE PREFERRED EMBODIMENTS

Figure 1:
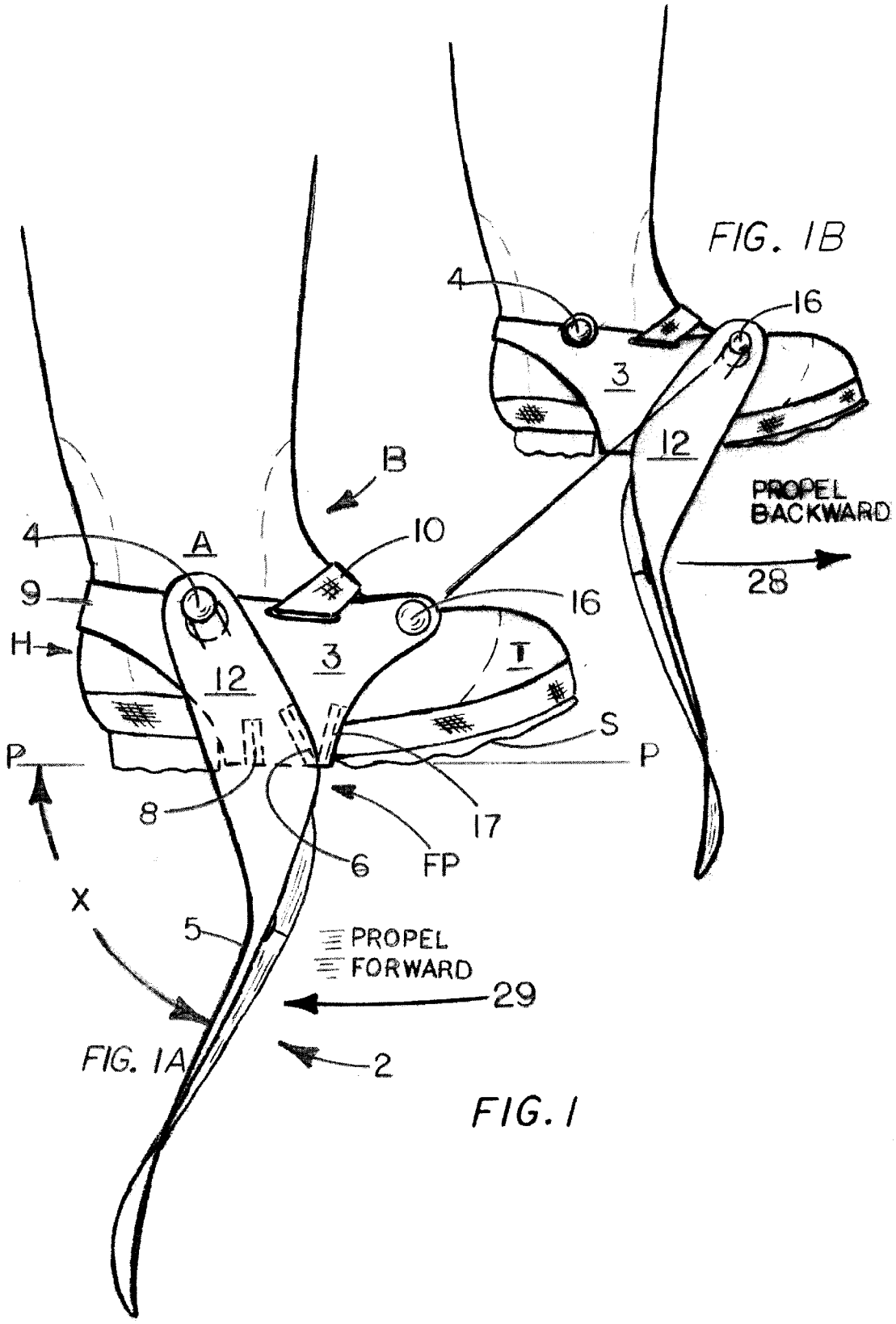
FIG. 1 shows alternate assemblies of the fin member to the base member.

The fin assembly of this invention shown in FIG. 1 is constructed of semi-rigid and flexible plastic material which can be molded by production machinery and processes such as injection molded plastic, although other suitable processes and methods can be used in manufacturing the fin assembly. In simplest form the assembly consists of a generally planar fin member 2 which is snap assembled to mounting studs 4, 16 and retained in the operating position by latch catches 8, 17 provided to be permanently adhered to or molded integral with wader boots B worn when using the fin assembly. Alternately a separate base member 3 with mounting studs and latch catches to retain the fin member 2 is provided for removable attachment over the user's boots B or other footgear.

Figure 8A:
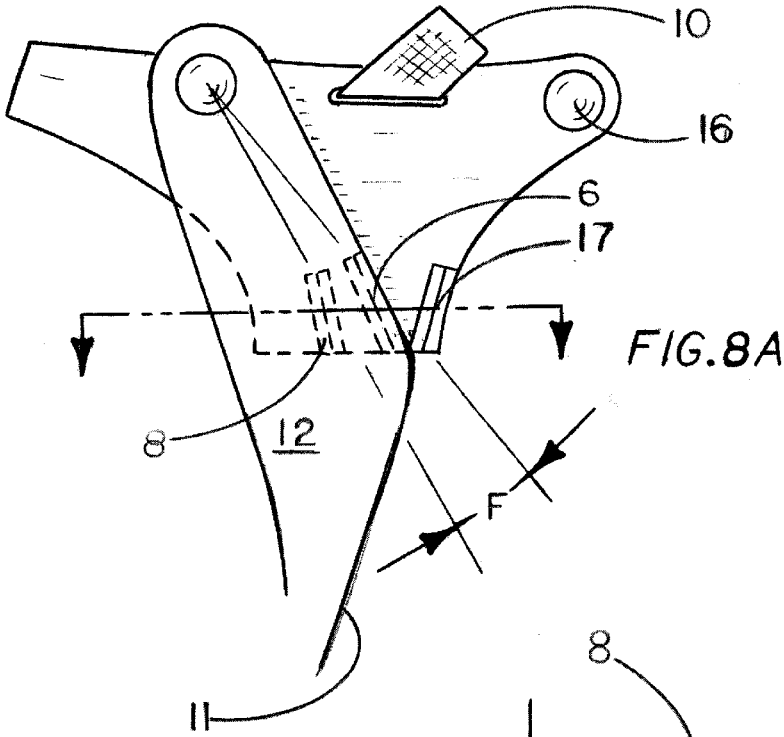
FIGS. 8, 8A & 8B show details of the operating position fin latches and detents.
Figure 8:
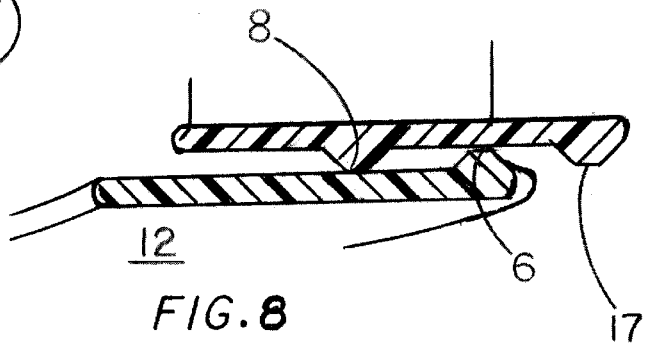
Figure 8B:
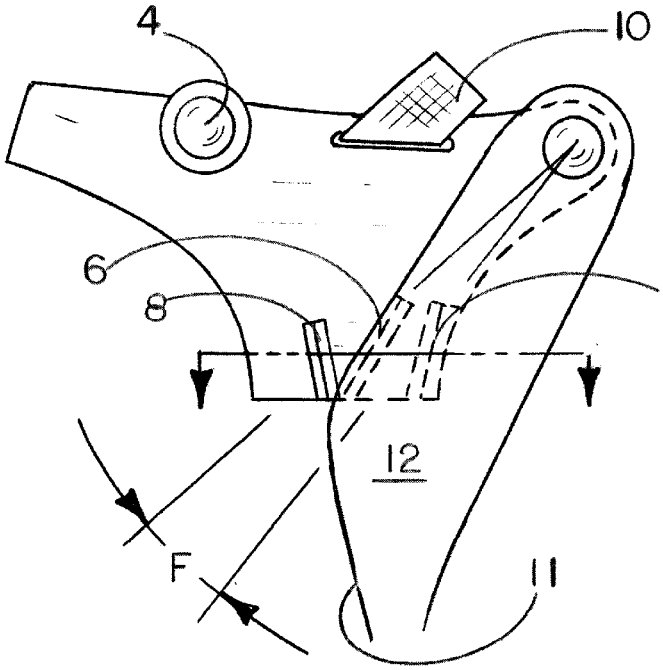
Figure 12:
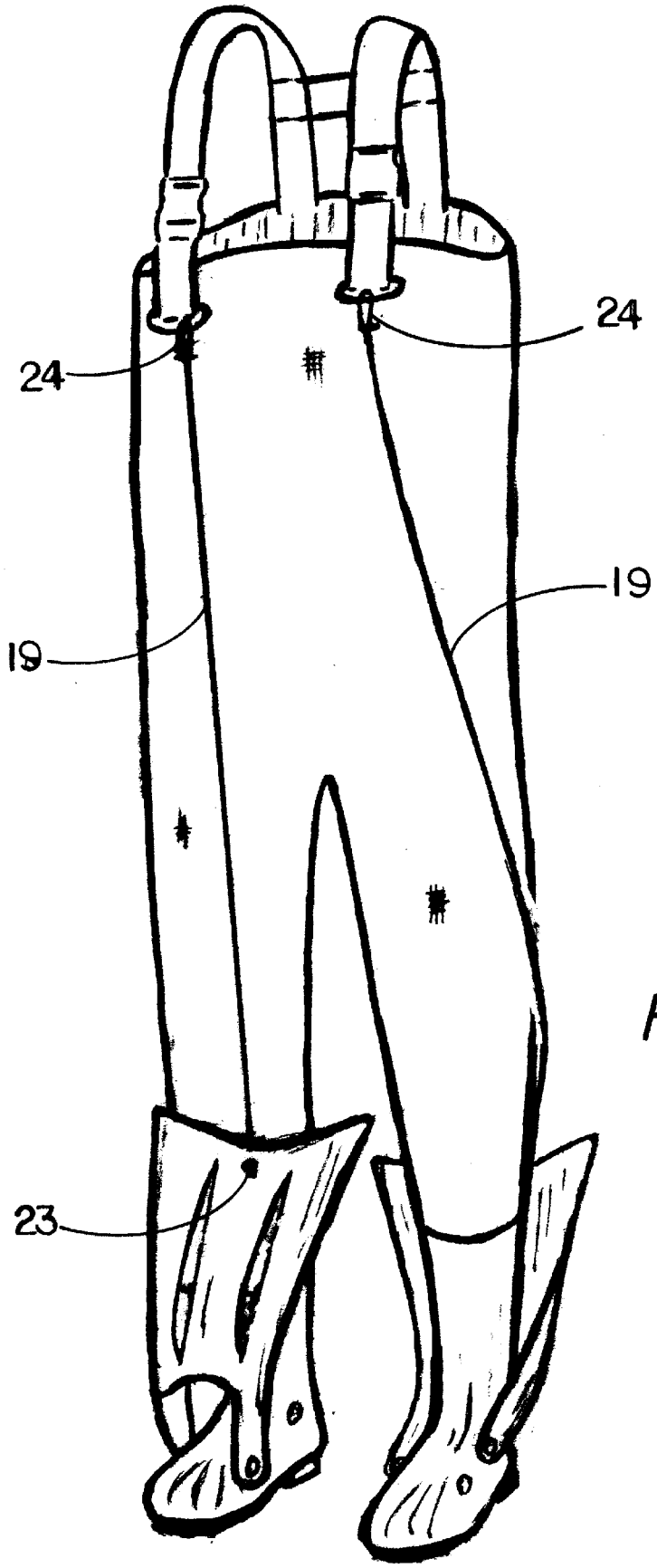
FIG. 12 shows the preferred method of retaining the fin members in their retracted positions, using a length of cord fastened at one end to the rear portion of the fin member and to a snap hook at the opposite end. The hook is snapped into "D" rings or alternately into a loop of cord tied about the wader suspenders. For illustration purposes only the right fin is shown assembled and oriented for backward propulsion and the left fin is shown assembled for forward propulsion (whereas normally both fins would be oriented to propel in the same direction).

FIG. 1 illustrates a side view of the outside portion of the right boot B, showing a sole S, toe portion T, ankle portion A, and heel portion H of the boot B. A fin member 2 is pivotally connected to rear mounting studs 4 of a base member 3 which is fastened to the user's boot by an adjustable heel strap 9 and a binding mechanism 10. The fin member upper surface 5 is oriented to the rear for a power kick to the rear indicated by an arrow K which will move the user forward in the water. The angle X of the general plane of the fin member 2 to the general plane P of the sole S of the boot B is critical to developing the greatest efficiency from the fin assembly. Angle X will vary depending on the relative stiffness and resiliency of the material from which the fin member is constructed and can best be determined by comparative testing in a float tube traveling an accurate distance in the water. I believe the preferred angle X will generally be in the range of 60°–75°, but if testing proves otherwise, the angle should be adjusted accordingly. Fin member 2 is retained in this position by latch structures 6 which are formed integral on the inside surfaces of the side extensions 12 of the fin member 2 which (latch structures) engage with latch catches 8 formed on the outer side surfaces of the base member 3, and by contact of the front portion FP of the fin member 2 with the underneath surface of the base member 3. In alternate embodiments such as the one shown in FIG. 3, the mounting studs 4, 16 and latch catches 8, 17 are directly affixed to the boot by cementing or molded as integral parts of the boot B. In the alternate embodiments the front portion FP of the fin member 2 contacts the sole S of the boot B. Referring to FIGS. 8, 8A & 8B for greater detail, latch structure 6 engaging latch catch 8 prevents the fin member 2 from pivoting rearward in a reset kick to the front in which the resistance of water meeting the fin member is against its lower surface 11. As shown in FIGS. 8, 8A, & 8B latch catch 8 is positioned to allow a range of free pivotal movement shown as angle F. This free movement in conjunction with the following described hinging of the fin member 2 aligns the fin member in a narrower angle closer to the sole S of the boot B for reduced drag on the reset kick. The optimum amount of free movement in angle F is believed to be generally less than 20 degrees, although it will vary depending on the relative stiffness and resiliency of the material used in the construction of the fin member 2. Similarly to the previous discussion of angle X the preferred range of free movement is best determined by comparative testing and should be adjusted according to test results. In alternate embodiments in which the fin member is attached to mounting studs which are permanently affixed on the boot, latch catches 8, 17 also are permanently affixed to or permanently molded as an integral part of the boot B. Fin member side extensions 12 retain the fin in its base operating position against the underneath surface of the base member or alternately against the sole of the boot under tension produced in a power kick. One or more ribs 20 or similar structure molded integral with the underneath fin surface 11 stiffen the fin member and prevent it from over flexing or doubling back on itself in a power kick. A hinge portion is formed across the fin member 2 by apertures 21 through the fin member which are positioned in conjunction with a cut or cleavage 22 through the ribs 20 as shown in FIGS. 6 & 6A. The rib cleavages 22 are formed in an interlocking "V" or "U" configuration to prevent stresses incurred in a power kick from distorting the mating ends of the cut rib portions which would allow them to slide past each other. As shown by phantom lines illustrating the fin member 2 in FIGS. 3 & 5 the hinge functions to further reduce drag on a reset kick shown by the arrow 15, allowing the rear portion RP of the fin to feather generally parallel to the plane P of the sole S of the boot B.

Figure 2:
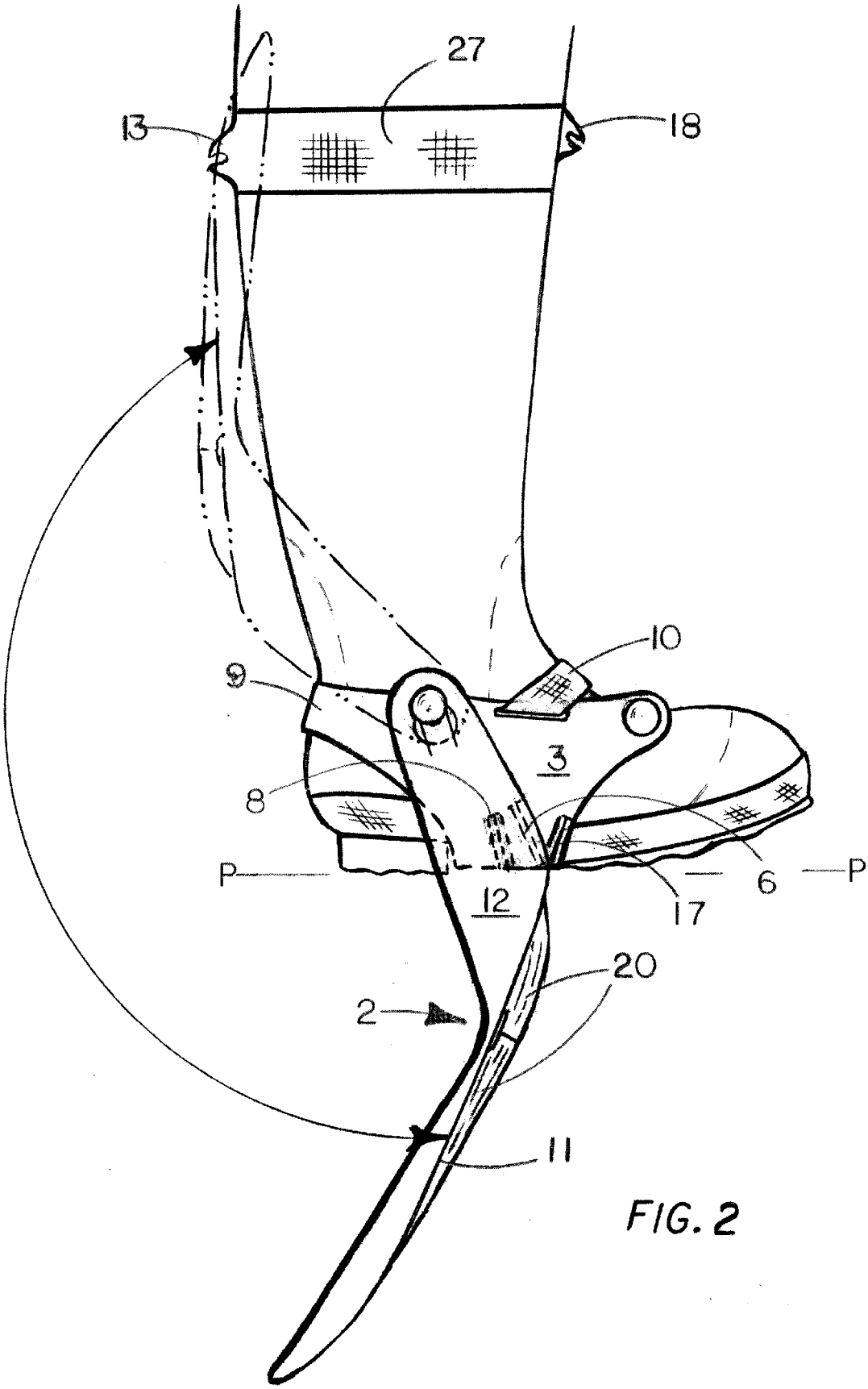
FIG. 2 is a side view showing the fin member mounted on the base member rear studs with the fin member positioned in its base operating position for propelling a user forward in the water. Phantom lines show the fin member pivoted to its fully retracted position for walking.
Figure 4:
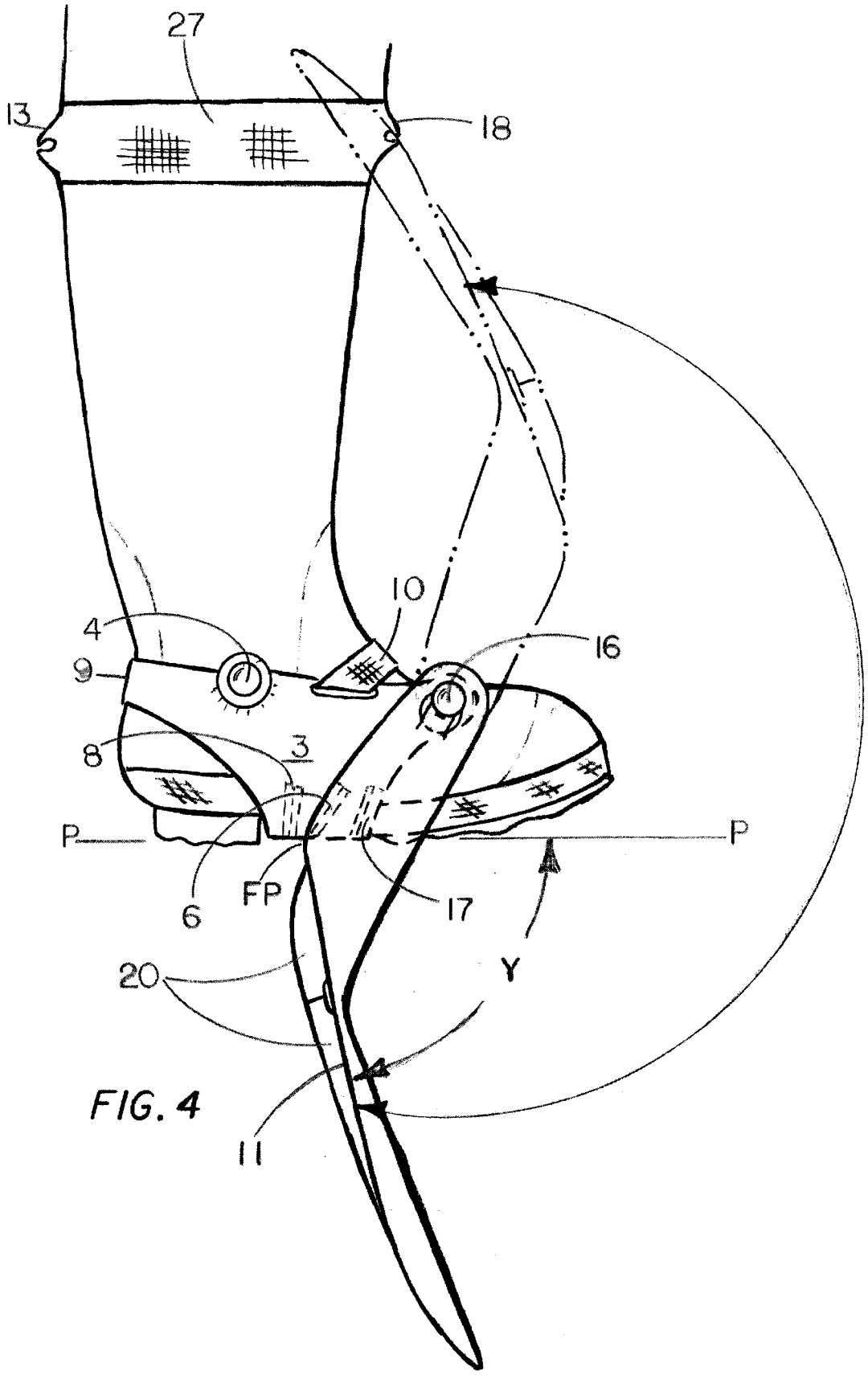
FIG. 4 is a side view showing the fin member mounted on the base member front studs with the fin member positioned in its base operating position for propelling a user backward in the water. Phantom lines show the fin member pivoted to its fully retracted position for walking.
Figure 7:
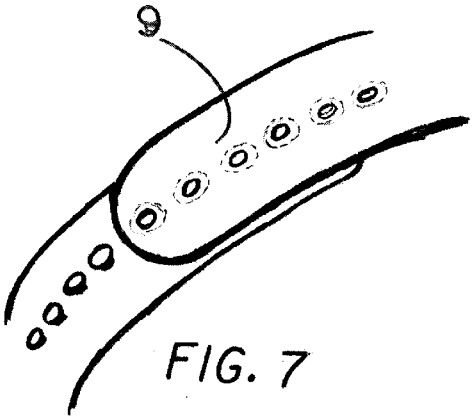
FIG. 7 is an enlarged drawing showing the preferred base member heel strap size adjustment means, which is an integrally molded snap strap
Figure 7A:
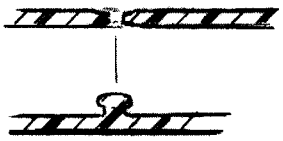

The base member 3 is securely mounted on the boot B being retained in position by an adjustable heel strap 9 shown in detail in FIGS. 7 & 7A which is molded integral as part of the base member 3 and a binding mechanism 10 which can be either webbing and quick release cam action or other buckles, or adjustable straps molded integral as part of the base member 3 which are tightened and secured by any of known over center or other buckle and fastening mechanisms. In preferred form the binding mechanism 10 provides a separating automatic release mechanism similar to that used on some downhill ski pole straps to free the user in the event the fin assembly becomes entangled in debris, endangering the user to injury or drowning which might otherwise occur with a non-releasing binding. A separate release mechanism is unnecessary in alternate embodiments in which the fin member is attached to permanently affixed studs on the boot, since the user could simply pull his or her leg from the boot if it were to become caught or entangled in debris. In FIGS. 2 & 4, phantom lines illustrate the fin-member 2 rotated to its vertical retracted position above the sole S of the boot B, adjacent the user's calf for walking forward on a surface. (FIG. 2 shows the fin member mounted on the rear mounting studs for propelling the user in a forward direction, while in FIG. 4 the fin member is reversed, mounted on the forward mounting studs for propelling the user in a backward direction. The following description of the retracted position latches should be interpreted accordingly) For ease of walking the fin member can be retained in this retracted position by the appropriate elastomer friction latch 13 or 18 (also shown in greater detail in FIGS. 11, 11A & 11B) which is held in position by a strap 27 passing around the boot B below the knee. In alternate embodiments in which the mounting studs and latch catches are permanently affixed to or molded integral as part of the boot, latch members 13 and 18 will also be permanently affixed or molded integral with the boot. Latches 13 and 18 have an opening slot 25 which is reduced at its terminal end to flex open allowing a mating fin latch member 26 to pass through the opening slot 25, being retained in in the slot 25 by the elasticity of the material from which the latch and fin member are formed. An alternate means (preferred for simplicity) of retaining the fin member in its retracted position for walking is shown in FIG. 12 and FIGS. 10, 10A & 10B. In this embodiment an appropriate length of cord 19 such as is commonly referred to as "parachute cord" is secured at one end to the rear portion of the fin member by passing the free end of the cord 19 opposite a knot 23 through a hole in the rear portion RP of the fin member 2 . The cord free end is then fastened to a hook 24 which is snapped onto "D" rings if provided in the wader suspenders or alternately onto a length of cord or other fastener tied or otherwise secured into the wader suspenders. An elastomer cord wedging structure 29 which alternately replaces retracted position latche members 13, 18 to further secure the rear portion RP of the fin member 2 close to the boot can be provided to be mounted on the waders by a removable strap 27 or as a permanent fixture cemented to or molded integral on the boots. When a user is floating in the water the cord is released from the wader suspenders and cord wedging structure 25 (if provided) to be snapped onto "D" rings provided on the float tube. This repositioning of the snap hook 24 will provide sufficient slack in the cord 19 for the fin member to be rotated to its extended position beneath the user's boot sole. In this manner the cord also functions as a "fin saver" and means of retrieving a fin which might become separated from the user's foot by release of the binding safety mechanism or inadvertent release of the fastener used in the binding mechanism 10.

FIG. 4 shows the fin member 2 pivotally attached to the user's boot B by the front mounting studs 16 of the base member 3. The fin member 2 is reversed in position from that shown in FIGS. 1, 2 & 3, being positioned for use in propelling a user backward in the water. Although the front portion FP of fin member 2 now is reversed, facing toward the user's heel in the drawing, to avoid confusion it will still be referred to as the front portion. The front portion FP of fin member 2 contacts the underneath surface of base member 3, retaining the fin member in its optimum position for maximum efficiency in kicking forward to propel the user in a rearward direction as the user faces. In this position, fin member latch catch 6 engages with a rear latch catch 17, (shown in greater detail in FIGS. 8, 8A & 8B) to retain the fin member 2 in its extended position on a reset kick to the rear. Phantom lines show fin member 2 rotated above the sole S of the boot B to its vertically retracted position in front of the user's leg for walking forward on a surface. The fin member 2 can be retained in this position by a retracted position latch 18 which operates in similar fashion to that of latch 13, which was previously described. Angle Y of the fin member 2 to the plane P of the sole S of the user's boot B also will vary depending on the stiffness and resiliency of the material from which the fin member is constructed. The preferred angle Y can best be determined by testing in a float tube traveling an accurate distance in the water. Generally it is believed the preferred angle Y will be in the range of 70 to 85 degrees, but if testing proves otherwise it should be adjusted accordingly.

Figure 3:
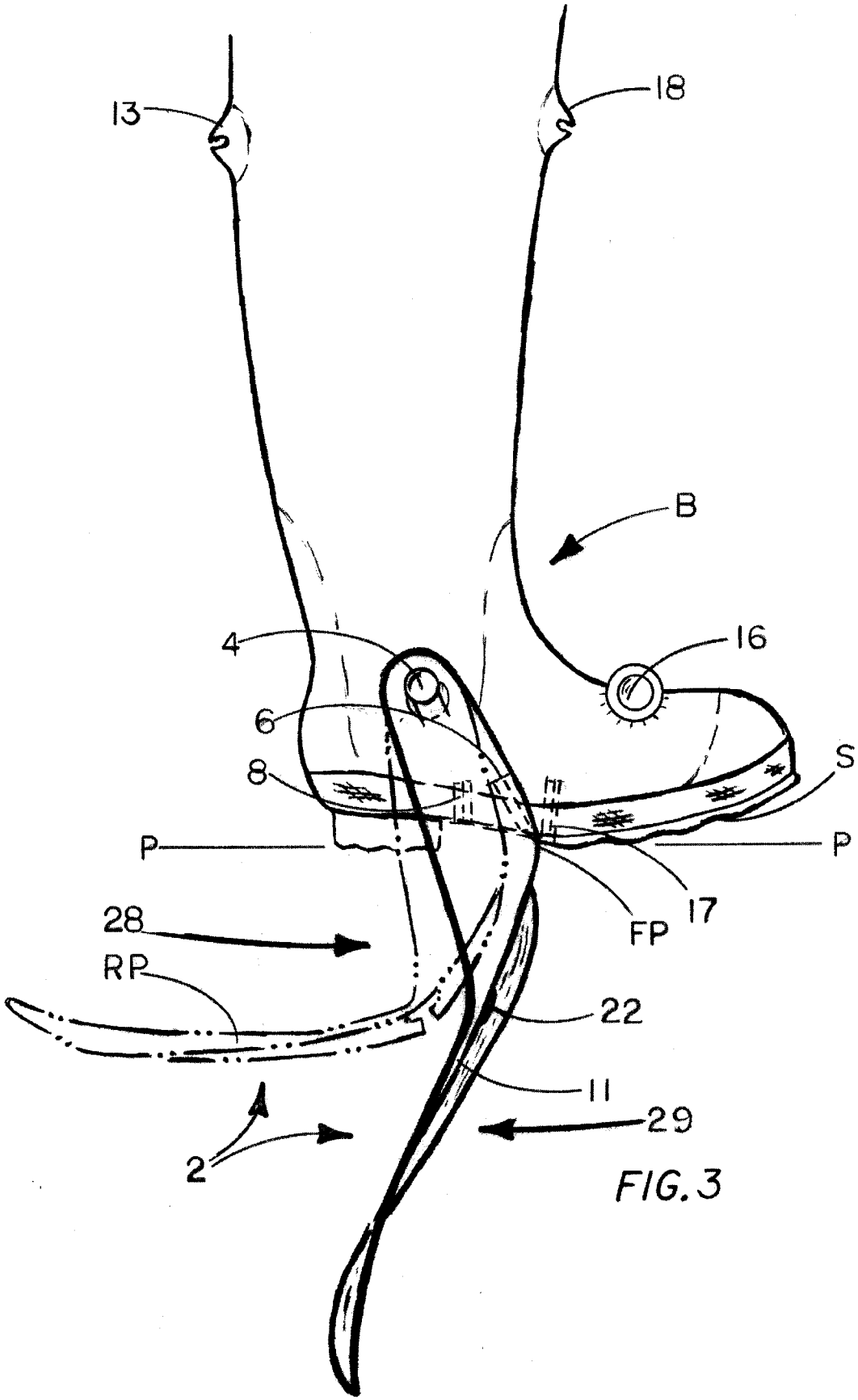
FIG. 3 shows the fin member attached to rear mounting studs which have been permanently attached to the boot by cementing or alternately by the studs being molded integral to the boot. The fin member is shown deflected by the force of water against it in a power kick to the rear propelling the user forward in the water. Phantom likes show the fin feathered in a reset kick forward.
Figure 5:
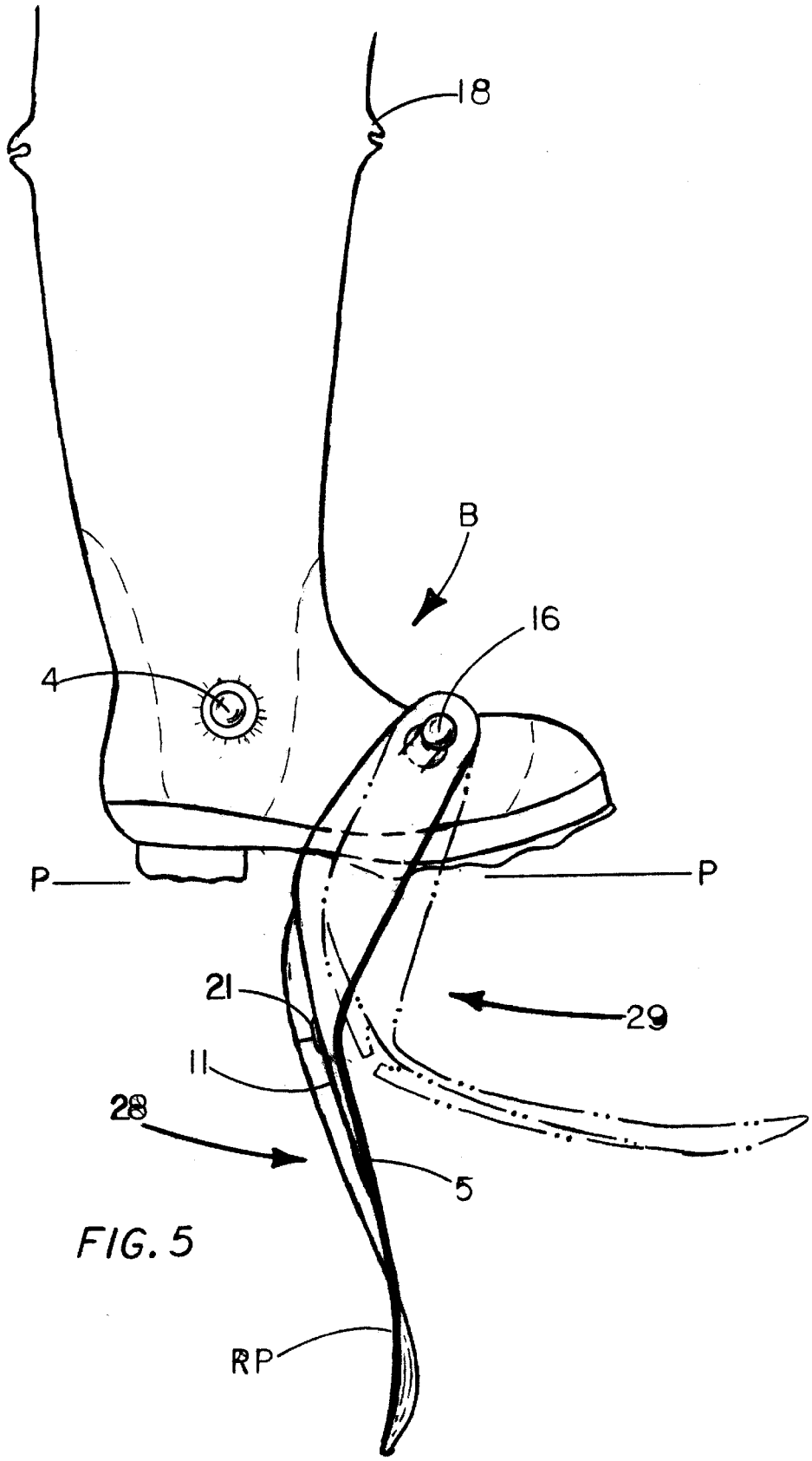
FIG. 5 shows the fin member attached to mounting studs which have been permanently attached to the boot by cementing or alternately by the studs being molded integral to the boot. The fin member is shown deflected by the force of water against it in a power kick to the front propelling the user backward in the water. Phantom lines show the fin feathered in a reset kick to the rear.
Figure 6:
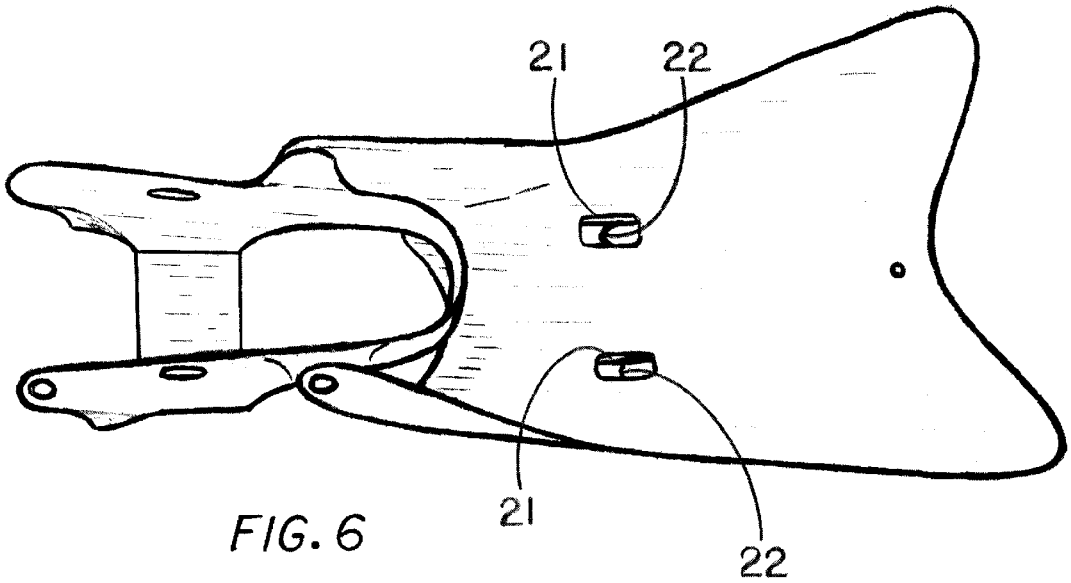
FIG. 6 shows the upper surfaces of the fin member and base member with the fin member attached to the base member and rotated approximately midway between the fully extended base operating position and the fully retracted position.
Figure 6A:
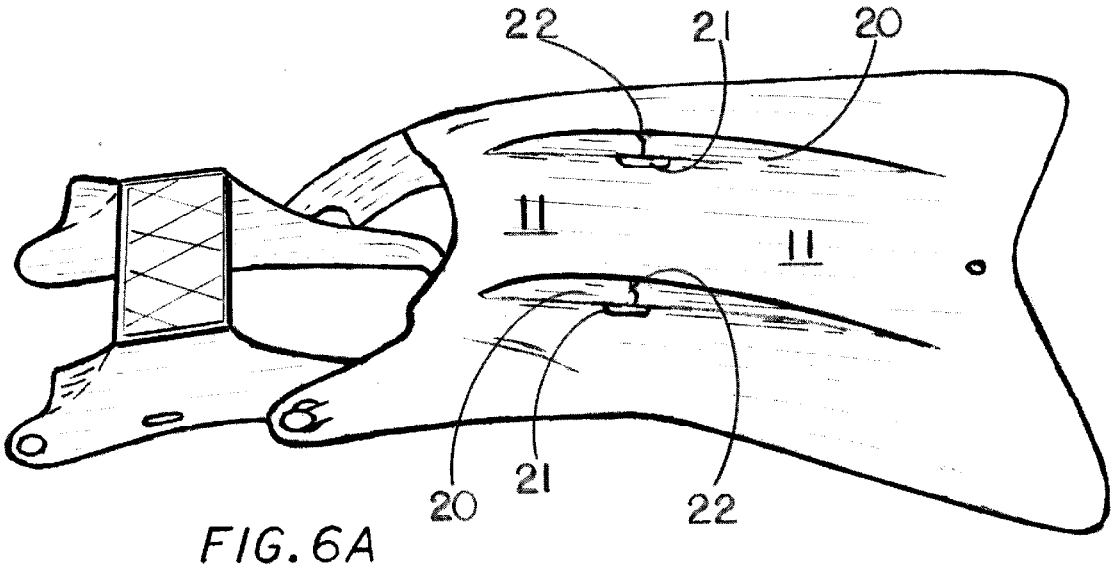
FIG. 6A shows the underneath surfaces of the fin member and base member with the fin member attached to the base member and rotated approximately midway between the fully extended base operating position and the fully retracted position.

FIG. 5 shows fin member 2 pivotally attached to the user's boot B by a permanently attached or integrally molded mounting stud 16, positioned closer to the toe of the boot B than the rear stud 4 which was previously described and is illustrated in FIG. 3. In this embodiment latch 17 also is permanently cemented to or molded integral as part of the boot B. The drawing illustrates the fin member 2 deflected by the force of water against its upper surface 5 in a power kick to the front as is indicated by the arrow 28. Phantom lines show the fin member 2 feathered in a reset kick to the rear as indicated by the arrow 29.

In operating the latch mechanisms the user releases the fin member 2 from its extended position latches 8, 17 by applying downward pressure on the fin against the bottom surface of the body of water in which the user is floating to release the fin member latch structure 6 from its mating catch 8, 17. With the fin released the user then uses The toe portion T of the opposite boot B to pivot the fin member 2 upward from its extended position to the retracted position, latching the retracted position latch 13, 18 with his or her hands and fingers. To extend the fin member to its operating position the fin member is released from the retracted position latch 13, 18 and allowed to pivot downward by the force of gravity to a position below the sole S of the user's boot B. From this position the water's resistance on the fin member upper surface 5 in a kicking movement engages the fin member latch structure 6 with the extended position latch catches 8, 17.

FIGS. 9, 9A &9B show details of the hinged connection of the fin member sides 12 to latch stud 4. The connection is similar for both studs 4 & 16 and both sides 12 of the fin member 2 regardless of the assembly of the members relative to the direction of propulsion in the water and regardless of whether the stud is formed as part of the base member 3 or cemented to or permanently molded integral as part of the boot B. As illustrated in the drawings in FIG. 9A & 9B, the stud 4 has a short cylindrical portion terminating in a larger headed portion which retains the fin member in its pivotal connection to the stud 4. FIG. 9 shows details of the hinge aperture in the sides 12 of the fin member. The aperture is similar to commonly known and used "keyhole" connections in which a stud member passes through an appropriately sized hole, being then moved to connect into a smaller hole of the size of the main pivoting portion of the stud. A locking tab is provided to prevent the stud from inadvertently sliding back into the larger hole.

Use of the fins, both in propelling in water and walking and wading is ergonomic, that is, as one would instinctively move. In particular the first preferred embodiment in which the fin member is simply removably attached to mounting fixtures already provided on waders offers both greater simplicity and universal functioning, being adaptable for use in propelling either forward or backward on the water while simultaneously allowing the user to walk forward without removing the fin member. With the fin member removed, the waders can be used in conventional fashion. Donning an annular float tube is considerably easier with the fin retracted vertically where it does not interfere or catch on the fabric of the float tube seat, as can be the case with a fin underneath the sole of the user's foot, or with a forward extending swim fin. Thus, the reader will see that the fin assembly of the present invention provides an inexpensive, simple, highly reliable and versatile lightweight fin assembly which can be adapted by both users of float tubes and pontoon boats to move in a desired forward or backward direction in water while still being able to walk and wade in a forward direction, adding to their enjoyment and reducing the dangers associated with slipping and falling into the water.

Although the foregoing description contains many specifics, these should not be construed as limiting the scope of the invention but as merely providing illustrations of some of the presently preferred embodiments of the invention. For example, the fin member of the invention can have other shapes such as irregular, simulating the footprint of a web footed animal or bird, oval, triangular, trapezoidal, and the like. It should be understood that the foregoing description is exemplary only, and that the scope of the present invention is to be limited to the claims as interpreted in view of the prior art. Moreover, the invention illustratively disclosed herein may suitably be practiced in the absence of any element which is not specifically disclosed herein.

I claim:

1. An improved fin assembly for attachment to the foot, foot covering or boot of a float tube or pontoon boat user or the user of a similar device, the boot or foot covering having a sole, toe, ankle, and heel portions, the assembly including a fin member having a front end portion, a rear end portion, an upper surface, a lower surface, and right and left sides, the fin member being removably connected to a removable, permanently attachable, or permanently installed mounting means for releasably attaching the fin member to the boot or foot covering of a float tube user, the mounting providing a releasable fin member attachment means including an articulated coupling of the fin member allowing the fin member while the fin assembly is attached to the user's foot to be selectively retained in a first retracted position wherein the fin member is positioned above the sole of the user's boot to enable the user to walk upon a surface without removing the fin member or fin assembly or to be selectively retained in a second operating position wherein the fin member is positioned below the user's boot sole for use in propelling the user in the water, flexure characteristics of the composition of the fin member material and the limiting configuration in which it is constructed allow the fin member to establish a first fully extended operating position in a power kick in which the flexure of the fin member is limited from exceeding the optimum position for maximum resistance to the flow of water against its upper surface when the fin member is moved through the water with the fin member upper surface leading into the direction of movement against the water thereby propelling the user in the opposite direction, or a second return operating position in which the lower surface of the fin member is moved leading into the water in which said second return operating position the fin member feathers in response to pressure of water flowing against the lower surface, flexing to the limit of the characteristics of the composition of the material from which it is constructed, when so feathered in the return operating position the plane of the rear portion of the fin member is generally more parallel to the plane of the sole of the user's boot than when the fin member is freely positioned in its base operating position, in the feathered return operating position the fin offers minimal drag or resistance to the flow of water against its lower surface.

* * * * *